US006056363A

United States Patent [19]

Maddox

[11] Patent Number: 6,056,363

[45] Date of Patent: May 2, 2000

[54] RECLINING COMPUTER CHAIR APPARATUS

[76] Inventor: Lee W. Maddox, 3055 Blodgett Dr., Colorado Springs, Colo. 80919

[21] Appl. No.: 08/998,698

[22] Filed: Dec. 29, 1997

[51] Int. Cl.[7] ..... A47C 1/024; A47C 1/035; A61G 15/00

[52] U.S. Cl. ..... 297/325; 297/327; 297/330; 297/71; 297/68; 297/329; 297/115; 297/344.14; 297/217.1; 297/161; 297/160; 297/423.24; 297/423.36

[58] Field of Search ..... 297/325, 327, 297/329, 330, 340, 68, 69, 71, 115, 135, 149, 161, 170, 173, 174, 217.1, 217.3, 344.14, 423.1, 423.19, 423.2, 423.22, 423.23, 423.24, 423.26, 423.28, 423.34, 423.35, 423.36

[56] References Cited

U.S. PATENT DOCUMENTS

| | | | |
|---|---|---|---|
| 3,025,108 | 3/1962 | Teague, Jr. | 297/327 |
| 3,172,699 | 3/1965 | Naughton | 297/327 |
| 3,536,355 | 10/1970 | Osbeck | 297/71 |
| 3,578,379 | 5/1971 | Taylor | 297/330 X |
| 3,804,460 | 4/1974 | Leffler | 297/330 |
| 3,866,973 | 2/1975 | Heubeck | 297/330 X |
| 3,889,998 | 6/1975 | Weiland | 397/330 |
| 3,934,927 | 1/1976 | Zur | 297/330 X |
| 3,934,928 | 1/1976 | Johnson | 297/300 X |
| 3,934,929 | 1/1976 | Rabinowitz | 297/330 X |
| 3,984,146 | 10/1976 | Krestel et al. | 297/330 |
| 3,999,799 | 12/1976 | Daswick | 297/325 X |
| 4,101,168 | 7/1978 | Ferro | 297/329 |
| 4,492,407 | 1/1985 | Broadhead | 297/68 X |
| 4,527,976 | 7/1985 | Behringer et al. | 297/71 X |
| 4,779,922 | 10/1988 | Cooper | 297/174 X |
| 4,790,599 | 12/1988 | Goldman | 297/327 |
| 4,915,450 | 4/1990 | Cooper | 297/217.3 X |
| 4,957,302 | 9/1990 | Maxwell | 297/325 X |
| 4,966,413 | 10/1990 | Palarski | 297/330 |
| 5,015,035 | 5/1991 | Stoeckl et al. | 297/330 X |
| 5,086,769 | 2/1992 | Vianello et al. | 297/68 X |
| 5,348,375 | 9/1994 | Steininger | 297/344.14 X |
| 5,612,718 | 3/1997 | Bryan | 297/115 X |
| 5,628,546 | 5/1997 | Boetzkes | 297/330 X |
| 5,646,313 | 7/1997 | Best et al. | 297/330 X |
| 5,765,910 | 6/1998 | Larkin et al. | 297/217.3 X |
| 5,790,997 | 8/1998 | Ruehl | 297/330 X |

*Primary Examiner*—Peter M. Cuomo
*Assistant Examiner*—Rodney B. White
*Attorney, Agent, or Firm*—G. F. Gallinger

[57] ABSTRACT

An apparatus which will largely prevent irritated ligaments, and sore necks and backs arising from spending long hours at a computer terminal by allowing the user to position themselves in multiple comfortable positions is disclosed. The apparatus for use with a monitor and keyboard comprises: a base; a carriage slidably mounted on the base; a seat member having rear, and front side portions, said seat member carried on the carriage; a back member having a lower side portion pivoted to the rear portion of the seat member; a leg member having an upper side portion pivoted to the front side portion of the seat member; an arm member carried by the carriage, said arm member having a front end portion adapted to carry the keyboard; a monitor arm carried by the carriage; and motorized threaded screws used to move the carriage on the base, and move the back and leg members relative to the carriage.

14 Claims, 2 Drawing Sheets

RECLINING COMPUTER CHAIR APPARATUS

FIELD OF INVENTION

This invention relates to computer ergonomics. More particularly this invention relates to a reclining chair apparatus which is adapted to support an individual, a computer monitor, and a keyboard in multiple operable positions.

BACKGROUND OF THE INVENTION

An increasing number of individuals spend a majority of their workday sitting at computer terminals. Maintaining one position all day is fatiguing. Many individuals are off work and collect Workmen's Compensation as a result of irritated ligaments in their wrists and hands. Many more suffer with sore necks and backs. There is an need for an apparatus which will allow them to position themselves, and computer components in multiple working positions. An apparatus which is comfortable and physically relaxing to work long hours in.

OBJECTS AND STATEMENT OF INVENTION

It is an object of this invention to disclose a reclining chair which carries and automatically positions a computer monitor and keyboard for use in multiple positions. It is an object of this invention to disclose an apparatus which enables one to view a computer monitor and type in an upright sitting position, in a prone position, or in multiple positions therebetween. It is an object of this invention to carry a half keyboard at a front end of an armrest so that one's hand is positioned above the keyboard in a typing position. It is yet a further object of this invention to provide adjustment so that the keyboard may be carried in multiple positions for reduction of fatigue and strain. It is yet a further object of this invention to disclose a motorized mechanism to facilitate adjustment of the reclining apparatus between positions while working.

One aspect of this invention provides for a reclining computer chair apparatus for use with a monitor and keyboard comprising: a base; a carriage slidably mounted on the base; a seat member having rear, and front side portions, said seat member carried on the carriage; a back member having a lower side portion pivoted to the rear portion of the seat member; a leg member having an upper side portion pivoted to the front side portion of the seat member; an arm member carried by the carriage, said arm member having a front end portion adapted to carry the keyboard; a monitor arm carried by the carriage; and motorized threaded screws used to move the carriage on the base, and move the back and leg members relative to the carriage.

A preferred aspect of this invention provides for the arm member being carried by the back member and half keyboards being carried by the arm members so that the monitor and keyboard are automatically positioned when the members of the apparatus are moved.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
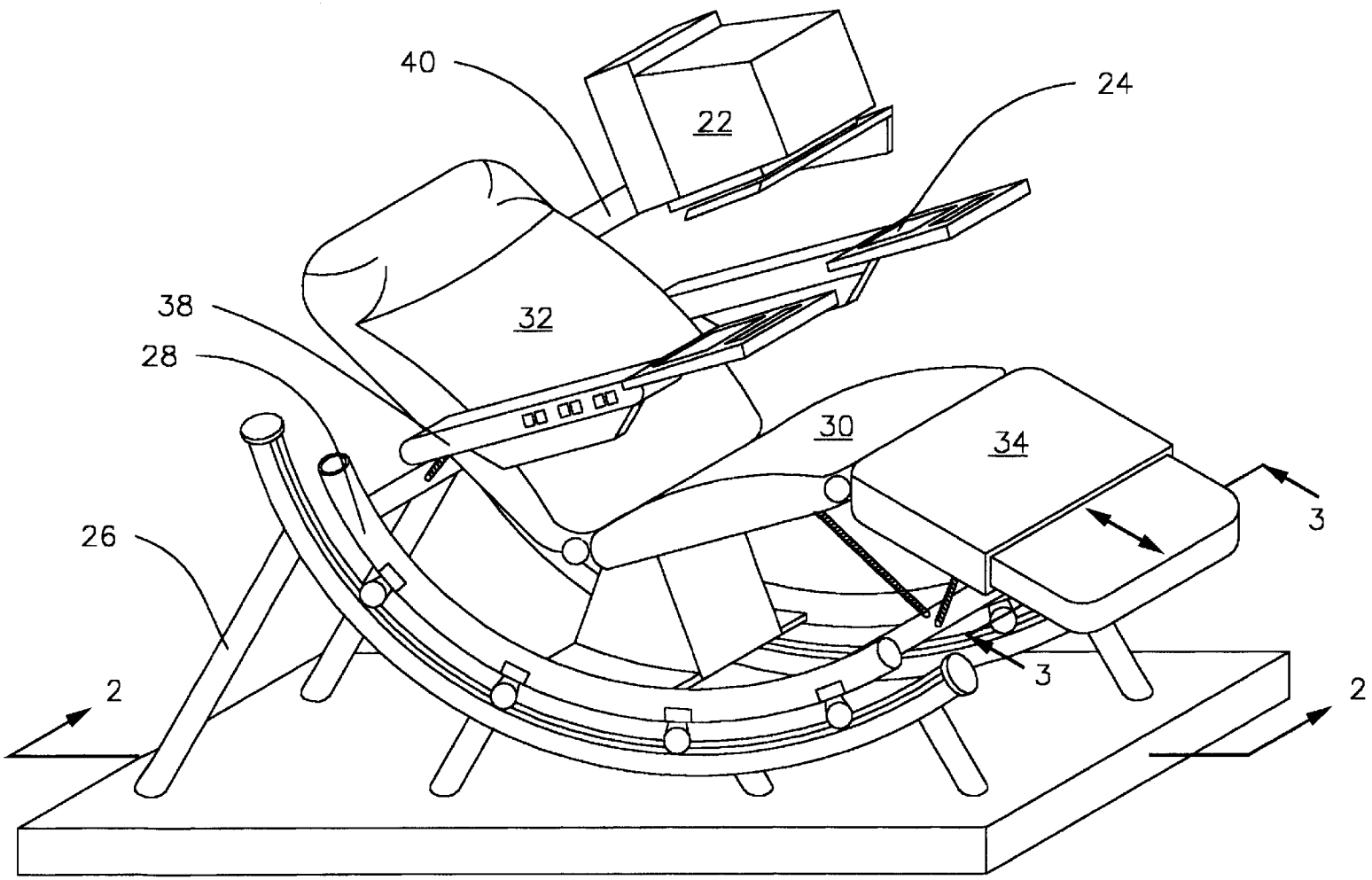
FIG. 1 is a perspective view of a reclining computer chair apparatus.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a reclining computer chair apparatus 20. The reclining computer chair apparatus 20 is designed to be used in combination with a desktop computer having a monitor 22 and a keyboard 24. Within this application monitor 22 is defined to include both a cathode ray tube monitor 22 and a flat screen monitor 22. The reclining computer chair apparatus 20 comprises: a base 26; a carriage 28 slidably mounted on the base 26; a seat member 30 having rear and front side portions, said seat member 30 carried on the carriage 28; a back member 32 having a lower side portion pivoted to the rear portion of the seat member 30; a leg member 34 having an upper side portion pivoted to the front side portion of the seat member 30; an arm member 38 carried by the carriage 28; support means (which most preferably is the front end portion of an arm member 38) carried by the carriage 28 to carry the keyboard 24; a monitor arm 40 carried by the lock member 32; and, means 42 to move the carriage on the base, and move the back member 32 and leg members 34 relative to the carriage 28. Most preferably the means for movement 42 comprises a remote power and control means.

In order to be both able to support an individual's feet when in an elevated position and facilitate movement of the leg member to a vertical position, the leg member 34 is also able to elongate and shorten. An inner end portion of the arm member 38 is attached to the back member 32 so that the monitor 22 will be automatically positioned when the back member 32 is positioned.

The arm member 38 is adapted to lockably and pivotably carry a half keyboard 24. In this application a half keyboard is defined to be a grouping of keys on a keyboard 24 which are normally typed by a single hand, either left or right, so that between a left half keyboard and a right half keyboard all of the keys on a common keyboard may be accessed. In the preferrred embodiment of the invention the keyboard 24 comprises a half keyboard 24. A half keyboard 24 is employed so that the portion of the keyboard 24 used by each hand is positioned thereunder. The keyboard 24 is lockably and pivotably carried by the arm member 38 so that it may be utilised in multiple positions to alleviate stress on the hand and tendons. One common method of lockable and pivotable attachment would include a hinge or pivot which could be locked in a preferred position by a thumbscrew.

Figure 2:
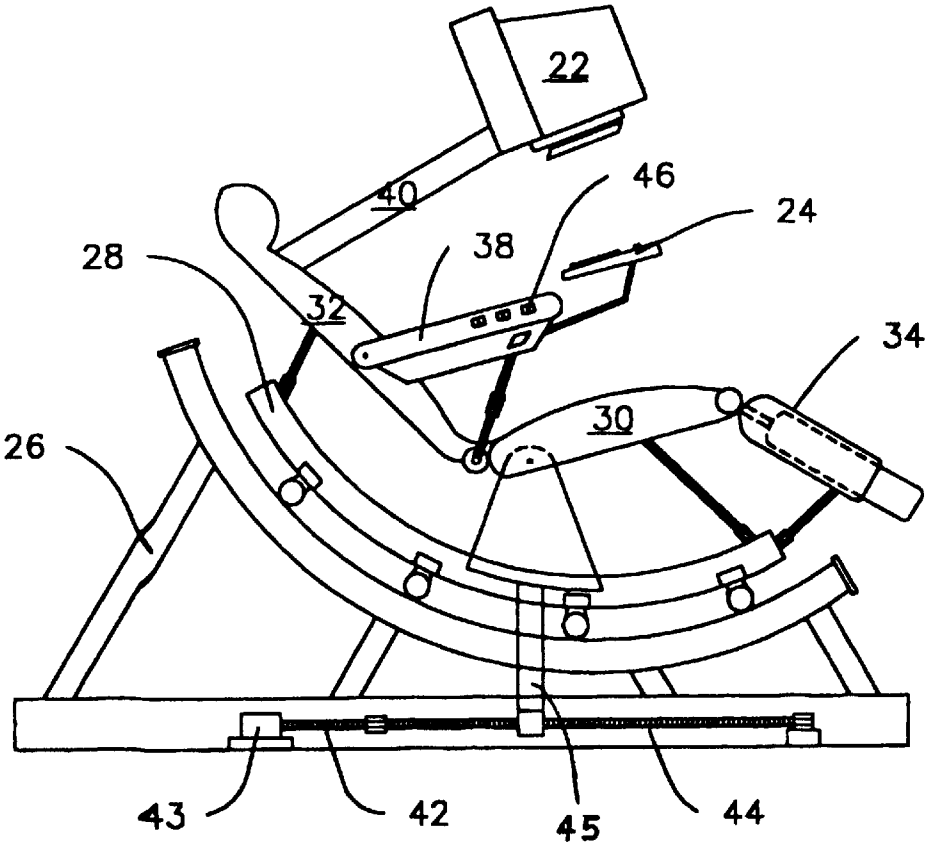
FIG. 2 is a cross sectional view of the apparatus shown in FIG. 1 taken along line 2—2.

FIG. 2 is a cross sectional view of the apparatus shown in FIG. 1. FIG. 2 best shows the remote power and control means 42 which comprises motor 43 driven threaded screws 44 controlled from rocker switches 46 on an arm member 38. A threaded screw 44 is moved to used to move the carriage 28 on the base 26. A motor 43, stationary with respect to the base 26, rotates the screw 44 either in a clockwise, or counter clockwise direction. Upright arm 45 threaded onto screw 44 moves either in a forward or rearward direction depending upon the direction of the screw 44. The carriage 28 is attached to upright arm 45 so that it is caused to move forwardly, or rearwardly, with the upright arm 45. The upright arm 45 could be slidably attached to the carriage 28 so that it might slip vertically with respect to the carriage 28 as it moved either forwardly or rearwardly. In a preferred aspect of the invention the seat member 30 is pivotably carried on the carriage 28.

Figure 3:
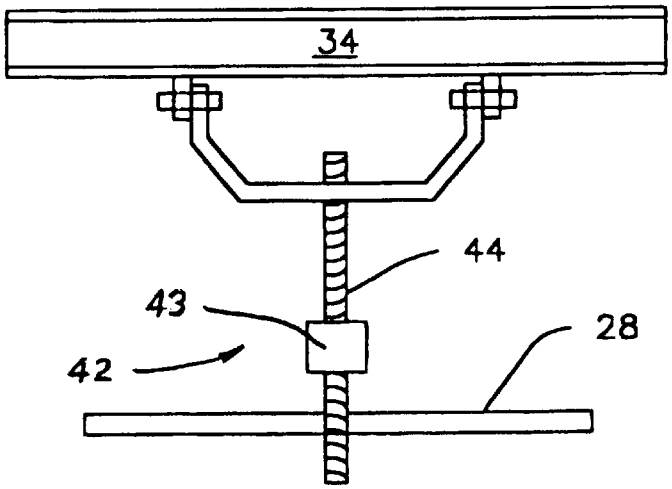
FIG. 3 is an enlarged view showing the hardware connections on a motorized screw. It is taken along line 3—3 in FIG. 1.

FIG. 3 is an enlarged view taken along line 3—3 in FIG. 1. FIG. 3 shows a suggested method of mounting a remote power and control means 42, comprising a motor 43 and a threaded screw 44 between the carriage 28 and the seat member 34. When the screw 44 is turned in one direction carriage 28 and seat member 34 are separated. When the screw 44 is turned in the other direction carriage 28 and seat member 34 are moved together. Threaded screws 44 are similarly used to adjust the seat member 30, back member 32, and leg member 34 relative to the carriage 28. A threaded screw 44 is used to adjust the position of the arm member 38 relative to the rear portion of the seat member 30. And a threaded screw 44 is used to elongate the leg member 34.

In a preferred aspect of the invention both the base member 26 and the carriage member comprise tubular structure. In the most preferred aspect of the invention the seat member 30, the back member 32, and leg member 34 are upholstered. In the most preferred embodiment of the invention the swithes 46 may be preprogrammed to automatically move the chair apparatus 20 to preferred positions.

It is contemplated that the reclining computer chair apparatus 20 might be sold in a cubicle to enhance privacy for the user.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A reclining computer chair apparatus for use with a monitor and keyboard comprising:

a base;

a carriage slidably mounted on the base;

a seat member having rear and front side portions, said seat member carried on the carriage;

a back member having a lower side portion pivoted to the rear portion of the seat member;

a leg member having an upper side portion pivoted to the front side portion of the seat member, said leg member adapted to longitudinally shorten and elongate so that when the leg member is in an upright position a particular user may sit in an upright position with their feet supporting their legs, and when the leg member is in a more lateral position leg supporting position, it may elongate to have sufficient length to support the particular user's feet as well as their legs;

an arm member carried by the carriage;

a monitor arm having an inner end portion directly carried by the back member so that once positioned by the particular user the monitor will automatically retain its position with respect to the chair in all chair positions;

support means carried by the carriage to carry the keyboard;

means to move the carriage on the base, and move the back and leg member relative to the carriage.

2. An apparatus as in claim 1 wherein the support means to carry the keyboard comprises an arm member having a front end portion adapted to lockably and pivotably carry the keyboard in multiple positions to alleviate stress on the hand and tendons.

3. An apparatus as in claim 2 wherein the seat member is pivotably carried on the carriage.

4. An apparatus as in claim 2 wherein the base member comprises a tubular structure.

5. An apparatus as in claim 2 wherein the carriage member comprises a tubular structure.

6. An apparatus as in claim 2 wherein the seat, back, and leg members are upholstered.

7. An apparatus as in claim 1 wherein the means to move the members comprises a remote power and control means.

8. An apparatus as in claim 7 wherein the remote power and control means comprises motor driven threaded screws controlled from the arm member.

9. An apparatus as in claim 8 wherein a threaded screw is used to move the carriage on the base.

10. An apparatus as in claim 9 wherein a threaded screw is used to adjust the position of the arm member relative to the rear portion of the seat member.

11. An apparatus as in claim 8 wherein threaded screws are used to adjust the seat, back, and leg members relative to the carriage.

12. An apparatus as in claim 11 wherein a threaded screw is used to elongate the leg member.

13. An apparatus as in claim 11 wherein one may move the chair to preferred preprogrammed positions.

14. A reclining computer chair apparatus for use with a monitor and keyboard comprising:

a base;

a carriage slidably mounted on the base;

a seat member having rear and front side portions, said seat member carried on the carriage;

a back member having a lower side portion pivoted to the rear portion of the seat member;

a leg member having an upper side portion pivoted to the front side portion of the seat member;

an arm member carried by the carriage;

a monitor arm having an inner end portion directly carried by the back member so that once positioned by the particular user the monitor will automatically retain its position with respect to the chair in all chair positions;

support means carried by the carriage to carry the keyboard;

means to move the carriage on the base, and move the back and leg member relative to the carriage.

* * * * *